US005271643A

United States Patent [19]

Hafele

[11] Patent Number: 5,271,643

[45] Date of Patent: Dec. 21, 1993

[54] SYSTEM FOR PROVIDING PRODUCT REORDERING INFORMATION

[75] Inventor: Wolfgang Hafele, High Point, N.C.

[73] Assignee: Häfele America Co., Archdale, N.C.

[21] Appl. No.: 845,274

[22] Filed: Mar. 3, 1992

[51] Int. Cl.[5] ..... B42D 15/00

[52] U.S. Cl. ..... 283/81; 283/67; 283/117

[58] Field of Search ..... 283/81, 117, 67

[56] References Cited

U.S. PATENT DOCUMENTS

| | | | |
|---|---|---|---|
| 1,601,018 | 9/1926 | Haynes | 283/105 |
| 4,549,750 | 10/1985 | Stone et al. | 283/79 |
| 5,178,417 | 1/1993 | Eshoo | 283/67 |

FOREIGN PATENT DOCUMENTS

| | | | |
|---|---|---|---|
| 3620264 | 12/1987 | Fed. Rep. of Germany | 283/81 |

*Primary Examiner*—Paul A. Bell

*Attorney, Agent, or Firm*—Rhodes, Coats and Bennett

[57] ABSTRACT

A system for organization, inventory control, and reordering of hardware items or the like. The system includes a rack to organize cartoned hardware items for easy access. End panels attached to each side of the rack displays the complete line of hardware available. Each carton includes a label attached to the carton's face. The label includes one portion that displays indica representing the particular item, e.g. a drawing of the hardware type, a description of the contents, and quantity. Each label also has a detachable perforated portion which may be peeled off from the carton and has a reusable pressure-sensitive backing. Order forms related to the labels of each hardware carton are also provided. Thus, when a carton is low, the user simply removes the perforated portion of the label from the face of the carton and affixes it to the order form to complete the order.

11 Claims, 2 Drawing Sheets

SYSTEM FOR PROVIDING PRODUCT REORDERING INFORMATION

BACKGROUND OF THE INVENTION (1) Field of the Invention

The present invention relates generally to pressure sensitive labels and, more particularly, to a system for providing product reordering information.

(2) Description of the Prior Art

Inventory control is becoming more important because of the cost of maintaining excess inventory verses the danger of running out of a critical component. As a result, almost all manufacturing plants have some type of inventory control system. However, some items are so small or so numerous and used in such quantities that they have been impractical to use as part of an inventory control system. Examples of such items include screws, dowels, pins, latches and brackets used in the furniture manufacturing industry. Even in these days of modern factories, it is not unusual to see such items in cigar boxes, baby jars, miscellaneous cans and unlabeled containers. In addition, there was no way of providing a convenient means for reordering when a particular item ran low.

U.S. Pat. No. 1,601,018, issued to Haynes, discloses a calendar equipped with a series of detachable tabs or tags which may constitute order blanks. In the preferred embodiment, the invention was adapted for use as a calendar advertising milk and other dairy products and providing order forms for the same.

U.S. Pat. No. 4 549 750 issued to Stone et al., discloses a two-piece label having one section which is marked by a supplier with general product information and a separable section on the same label which is marked with certain pricing information for the consumer. The label is then attached to the product shipping container in a fashion such that the general product information remains permanently attached to the container and the consumer pricing information section can be removed and placed on a store shelf at the same time the product is removed from the container and placed on the shelf.

Thus, there remains a need for a new and improved method and apparatus for organization and inventory control of hardware items or the like while, at the same time, providing a convenient means for reordering when a particular item runs low.

SUMMARY OF THE INVENTION

The present invention is directed to a system for organization, inventory control, and reordering of hardware items or the like. The system includes a rack to organize cartoned hardware items for easy access. End panels attached to each side of the rack displays the complete line of hardware available. In the preferred embodiment, the cartons have a flip-top and roll-cut front panel which permits easy access to the items within. Each carton includes a label attached to the carton's face. The label includes one portion that displays indica representing the particular item, e.g. a drawing of the hardware type, a description of the contents, and quantity. Each label also has a detachable perforated portion which may be peeled off from the carton and has a reusable pressure-sensitive backing. Order forms related to the labels of each hardware carton are also provided. Thus, when a carton is low, the user simply removes the perforated portion of the label from the face of the carton and affixes it to the order form to complete the order. In addition, the labels may be color-coded as to the type of hardware, i.e., connectors, wood assembly, accessories, etc.

Accordingly, one aspect of the present invention is to provide a system for organization, inventory control, and reordering of hardware items or the like. The system includes: (a) at least one carton for containing a group of identical items; (b) a two piece label, the label including one portion affixed to the carton that displays indica representing a particular item and a detachable portion that displays indica representing reordering information for the particular item; and (c) an order form adapted for receiving the detachable portion of the label whereby the user affixes the detachable portion of the label to the order form to complete an order.

Another aspect of the present invention is to provide s label for use with a system for organization, inventory control, and reordering of hardware items or the like. The label includes: (a) a first portion affixed to a carton containing the item that displays indica representing the particular item; and (b) a detachable second portion that displays indica representing reordering information for the particular item.

Still another aspect of the present invention is to provide a system for organization, inventory control, and reordering of hardware items or the like. The system includes: (a) at least one carton for containing a group of identical items; (b) a two piece label, the label including one portion affixed to the carton that displays indica representing a particular item and a detachable portion that displays indica representing reordering information for the particular item: (c) an order form adapted for receiving the detachable portion of the label whereby the user affixes the detachable portion of the label to the order form to complete an order; and (d) a rack for displaying a plurality of the cartons.

These and other aspects of the present invention will become apparent to those skilled in the art after a reading of the following description of the preferred embodiment when considered with the drawings.

DESCRIPTION OF THE PREFERRED EMBODIMENTS

Figure 1:
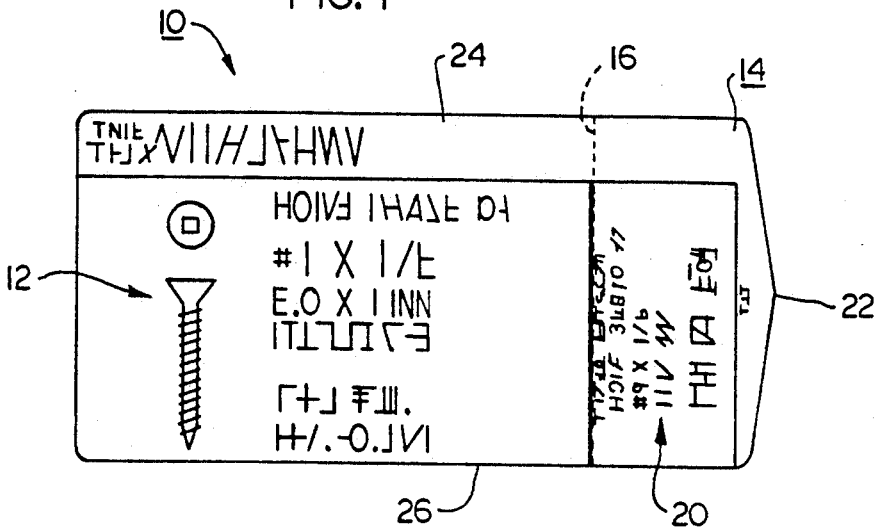
FIG. 1 is an enlarged, front elevational view of a two-section label constructed according the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a label, generally designated 10, is shown constructed according to the present invention. The label 10 includes indicia 12 setting forth the quantity, a description including, for example, name, size and any special treatment, and a picture of the item the label represents.

The label 10 also includes a separable section 14 attached to the main section along perforated tear-line 16. Separable section 14 includes order indicia 20 as to the part number and quantity of the item. In addition, separable section 14 also includes a peel tab 22 along one edge of the section which permits the separable section to be easily removed from the main body of the label.

In the preferred embodiment, at least one edge of the label and the separable section 14 includes a color-coded strip which indicates the type of hardware, i.e., connector, wood assembly, accessories, etc. An adhesive backing 26 on the label surface secures the main body of the label to be attached to a carton (see FIG. 3) containing the hardware items while, at the same time, permitting the detachable portion 14 to be removed.

Figure 2:
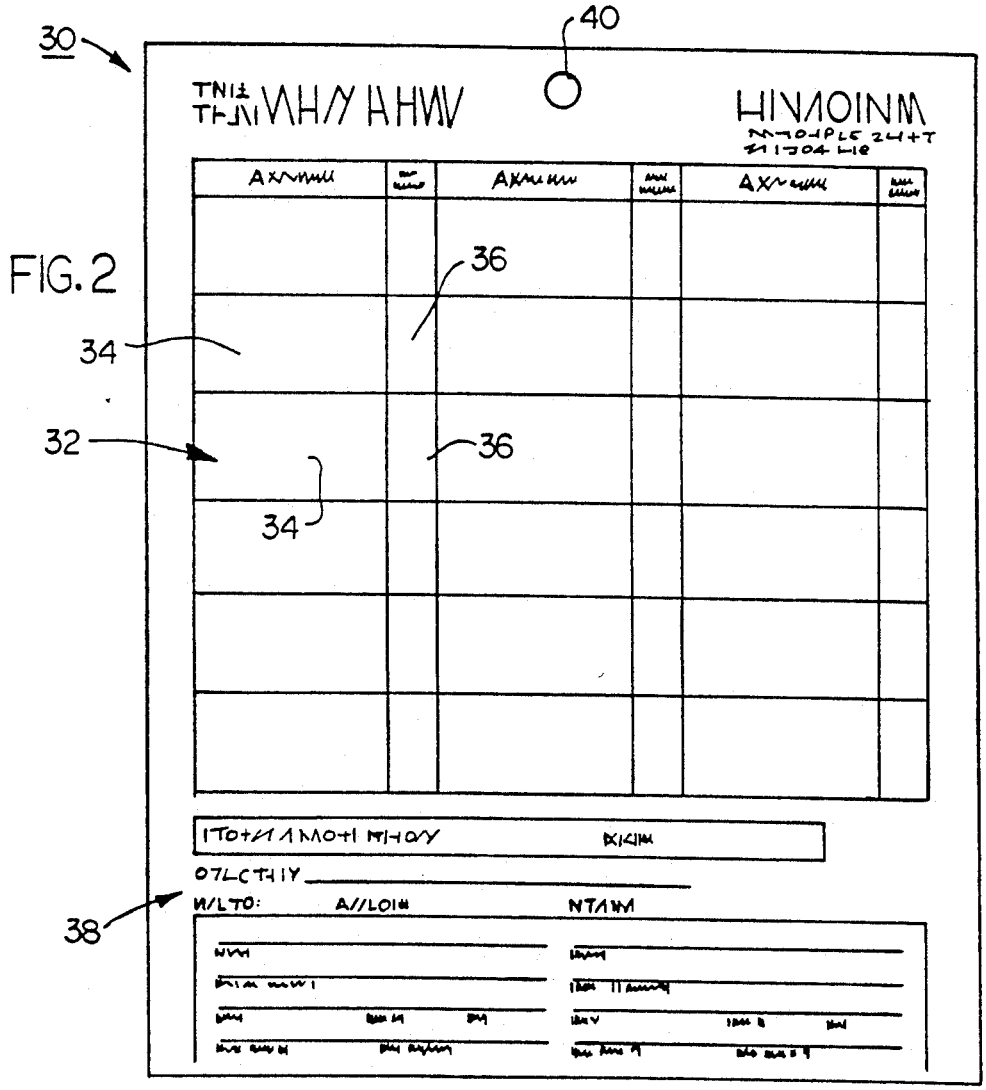
FIG. 2 is a front elevational view of an order form for utilizing the label shown in FIG. 1.

Turning now to FIG. 2, there is shown a front elevational view of an order form, generally designated 30, for utilizing the label 10 shown in FIG. 1. Order form 30 includes an order portion 32 which includes a plurality of boxes 34 arranged in, for example, a column format. Each box 34 is sized to receive separable sections 14 from label 10. As discussed above, separable section 14 includes the necessary order indicia for reordering the hardware items in the carton.

In the preferred embodiment, order portion 32 also includes an order block section 36 adjacent to each of the plurality of boxes 34 to allow the user to indicate the quantity of items to be reordered. The lower part of order form 30 includes a section 38 for allowing the user to provide additional reordering information such as purchase order number, date, person ordering, account number, shipping information, etc. Also in the preferred embodiment, order form 30 includes at least one aperture 40 for permitting the order forms to be easily bound together in a loose leaf binder.

Figure 3:
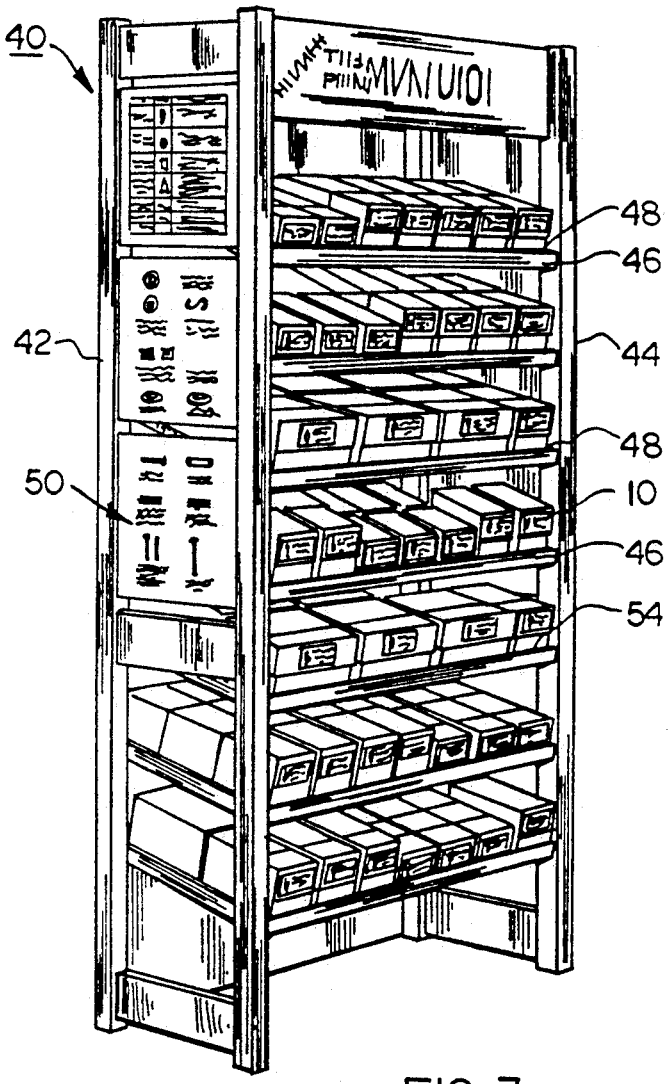
FIG. 3 is a perspective view of a rack for displaying cartons utilizing the labels shown in FIG. 1.

As best seen in FIG. 3, there is shown a perspective view of a rack 40 adapted for displaying a number of cartons utilizing the label 10 shown in FIG. 1. Rack 40 includes a pair of generally rectangular side walls 42,44 for supporting a plurality of slanted shelves 46. Each shelf includes a front stop 48 for preventing the front carton from sliding off the shelf.

In the preferred embodiment, each side wall 42,44 includes a display 50 which provides a pictorial illustration of all of the items available for order. Also in the preferred embodiment, each shelf includes a plurality of vertical separators 52 which, preferably, divide each shelf into three double compartments and one single compartment. Since each double compartment can also hold two single cartons and there are seven shelves, this permits the rack to hold between 28 and 49 different items at one time. Also in the preferred embodiment, a second label 10 corresponding to the label on each carton may be placed on the upper surface of the shelf on which the carton resides as a reminder of which item belongs in that particular location.

In operation, when a carton is low, the user simply removes the perforated portion of the label from the face of the carton and affixes it to the order form to complete the order. The label portion that displays indica representing the particular item, e.g. a drawing of the hardware type, a description of the contents, and quantity remains affixed to the carton. The end panels attached to each side of the rack displays the complete line of hardware available as a reminder to the user.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A system for organization, inventory control, and reordering of hardware items or the like, said system comprising:

(a) at least one carton for containing a group of identical items;

(b) a two piece label, said label including one portion affixed to said carton that displays indica representing a particular item and a detachable portion that displays indica representing reordering information for the particular item, wherein said label further includes a perforated tear strip between said first and second portion of said label and a color coded strip across one edge of each of said first and second portions of said label for indicating the type of hardware;

(c) an order form adapted for receiving said detachable portion of said label whereby the user affixes the detachable portion of said label to said order form to complete an order; and (d) a rack for displaying a plurality of said cartons.

2. The system according to claim 1, wherein said carton is a parallelepiped box.

3. The system according to claim 1, wherein said rack includes end panels attached to each side of said rack displaying the items available for order.

4. The system according to claim 1, wherein said rack includes a plurality of shelves for supporting said plurality of said cartons.

5. The system according to claim 4, wherein said plurality of shelves for supporting said plurality of said cartons are downwardly sloped towards the front of said rack.

6. The system according to claim 5, wherein said plurality of shelves for supporting said plurality of said cartons include a front stop for preventing said cartons from sliding off said shelves.

7. The system according to claim 4, wherein said plurality of shelves for supporting said plurality of said cartons includes at least one strip for separating adjacent rows of said cartons.

8. The system according to claim 1, wherein said order form adapted for receiving said detachable portion of said label includes at least one column having a plurality of rows whereby the user affixes the detachable portion of said label to one of said rows to complete an order.

9. The system according to claim 8, wherein said order form adapted for receiving said detachable portion of said label includes a blank column adjacent to each of said first columns for the user to enter a number corresponding to the quantity of the item to be reordered.

10. The label according to claim 1, wherein said detachable second portion includes a reusable adhesive backing.

11. The label according to claim 1, wherein said detachable second portion includes a peel tab adjacent to one edge to aid in removal of said second portion from said carton.

* * * * *